US005186559A

United States Patent [19]

Fu

[11] Patent Number: 5,186,559

[45] Date of Patent: Feb. 16, 1993

[54] COOKING SAUCE DISPENSER AND STAND

[76] Inventor: Peter P. Fu, 2 Berkshire Way, San Francisco, Calif. 94132

[21] Appl. No.: 731,498

[22] Filed: Jul. 17, 1991

[51] Int. Cl.[5] ..... A46B 11/02; B65D 35/22; B65D 35/56

[52] U.S. Cl. ..... 401/44; 401/47; 401/131; 401/184; 401/186; 401/271; 401/276; 222/94; 222/192; 222/212; 222/526

[58] Field of Search ..... 206/229; 222/94, 192, 222/185, 212, 215, 526, 533; 401/44–47, 131, 156, 184, 186, 271, 276, 183, 185

[56] References Cited

U.S. PATENT DOCUMENTS

| | | | |
|---|---|---|---|
| 1,030,440 | 6/1912 | Waterman | 401/186 |
| 1,221,587 | 4/1917 | Pratt | 401/131 X |
| 2,729,505 | 1/1956 | Harvey | 401/186 X |
| 2,904,811 | 9/1959 | Rabelow | 401/186 |
| 3,101,506 | 8/1963 | Himes et al. | 401/186 X |
| 3,782,600 | 1/1974 | Columbus | 401/195 X |
| 5,035,251 | 7/1991 | Hollenberg et al. | 401/183 X |

FOREIGN PATENT DOCUMENTS

| | | | |
|---|---|---|---|
| 194418 | 9/1986 | European Pat. Off. | 401/131 |
| 946816 | 8/1956 | Fed. Rep. of Germany | 401/46 |
| 1532803 | 3/1970 | Fed. Rep. of Germany | 401/45 |
| 818598 | 8/1959 | United Kingdom | 401/44 |
| 888091 | 1/1962 | United Kingdom | 401/183 |

*Primary Examiner*—Danton D. DeMille

*Attorney, Agent, or Firm*—Laurence Coit

[57] ABSTRACT

This invention is a cooking sauce dispenser comprising an assembly of one or more tubular, squeezable containers having a circular opening in a plane at an oblique angle to the axis of the container and connected rotatably to a collar having a flow passage for each container. The flow passage for each container is attached to an individual, heat resistant flow tube which terminates in a drip proof flapper valve. The distal end of each flow tube fits into a common flow directing nozzle which contains a bristle brush for applying the sauce to food. The drip proof valves are designed to accommodate sauces of varying viscosities and sauces containing chunky ingredients. The bristle brush is detachable and easily replaced with brushes of varying stiffness. By rotating a particular container, the container is caused to extend at an acute angle from the axis of the dispenser. The rotated container is thus easily identified as having the sauce being used for a particular dish and is used as a handle when applying sauce to food. In addition, the acute angle provides a comfortable configuration for applying sauce to food and keeps the users hand out of the hot region directly above the food. When not in use, the dispeners is held upright in a stand configured for the unique shape of the dispenser. The stand can be mounted on virtually any surface. A transparent brush cap is included to protect and keep clean the applicator brush. The cap contains graduation marks and can be used as a mixing and measuring cup.

13 Claims, 7 Drawing Sheets

COOKING SAUCE DISPENSER AND STAND

BACKGROUND OF THE INVENTION

The field of this invention relates to cooking liquid dispensers for applying a cooking liquid, sauce or glazing, hereafter referred to as sauce, to food as the food is being cooked.

During preparation and cooking of food, it is often desirable to apply a sauce to enhance the flavor and appearance of the food. Sauces are commonly applied to meats, fish, poultry and vegetables during cooking. Beside enhancing the flavor of the food, the sauce acts to protect the food from flame or high heat when the food is cooked over coals such as in a barbecue, stove or bakery oven. Also, cooking oil and other liquids are often applied periodically to food being cooked to replenish the moisture lost during the cooking process and to enhance the attractiveness of the food.

There are a wide variety of sauces used during cooking including honey, tomato based sauces, ketchup, spicy barbecue sauce, soy sauce, olive oil, sesame seed oil, vinegar, fruit juices, wines and various marinades. Thousands of recipes for combining these sauces into a particular marinade are available and often cooks develop their own special recipe. In addition, glazings such as syrup, egg, chocolate and the like are commonly applied to the surface of bakery items.

Food may be soaked or marinated in the sauce for a period of time before cooking to allow better absorption of the sauce into the food and to help tenderize the food. During cooking of the food, additional sauce is applied to the food periodically to replace liquid which naturally evaporates during the cooking process. Application of the sauce to the food during cooking is accomplished in various fashions. Perhaps the most direct manner is to open the oven or barbecue and pour the sauce directly from its container onto the food. This method ususlly results in portions of the food being covered with thick patches of the sauce while other portions are left with a very thin coating of sauce or none at all. Consequently, the cooked food lacks uniformity in taste, moisture and texture. In addition, pouring the sauce on the food usually results in sauce running off the edges of the food directly onto the oven surfaces or into the coals of the barbecue resulting in excessive smoke and a burned on layer of sauce on the oven or barbecue which then becomes very difficult to clean.

Another approach to applying sauce is to use a wide mouthed container or pan to hold the sauce and a basting brush. The brush is dipped in the sauce and then the sauce is "painted" on the food. This approach results in a uniform application of the sauce on the food and prevents sauce from running off the edges of the food. Also, the bristles of the brush help to roughen the surface of the food providing ridges or indentations for the sauce to adhere. However, because the basting is done periodically with a relatively short period of time between each application of the sauce, there is not enough time to clean the brush between applications. Thus, the brush is usually left on a counter top with sauce running off the bristles leaving an unsightly mess on the counter. Also, frequent and inconvenient dipping of the brush into the sauce is required to replenish the sauce on the brush. The redipping of the brush often introduces organic food particles into the sauce resulting in contamination. In addition, the sauce container is usually left open for easy access and the sauce looses much of its volatile contents thereby decreasing its flavor and bouquet. If cooking is taking place outdoors, both the brush and open container attract insects and thus create unsanitary conditions and inconvenience.

Another problem with the basting brush approach is that if two or more sauces are applied separately, it is difficult to control how much of each sauce is used. The brush soaks up varying quantities of the sauce depending on how long it is dipped in the sauce and the amount of agitation or movement the user applies to the brush while it is dipped in the sauce. This change in the amount of sauce applied can cause significant variations in the taste and thus lower the quality standard of the cooked food. Also, use of one brush with multiple sauces causes undesirable intermixing of the different sauces in their respective containers. This can lead to degradation of the pure taste of each of the sauces and in some cases ruins a particular sauce which otherwise could have been saved for later use. To prevent contamination of the sauces when multiple sauces are applied to the same food or when different sauces are used on different dishes being cooked at the same time, multiple brushes must be used which results in more of a mess. Yet another problem with the basting brush approach is that if sauces contain chunky ingredients, it is difficult for the brush to transfer such ingredients to the food and such ingredients usually end up unused at the bottom of the sauce container.

One approach to resolving these problems is shown in U.S. Pat. No. 4,796,806, issued Jan. 10, 1989 to Joyce P. Reid. That patent discloses a container for barbecue sauce having a manually operated spray pump mounted on top of the container. The spray pump outlet consists of a circular disk with multiple holes. Manually depressing the pump plunger causes sauce to be drawn out of the container and discharged out of the holes in an even spray. In this manner, the difficulties of the sauce pour on method of application are overcome and the mess associated with the basting brush is avoided. However, the spray applicator has a number of problems. Spraying the sauce in the form a fine mist or spray causes the volatile components of the sauce to evaporate before contacting the food. Also the sauce is not easily applied to crevices in food such as the folds in chicken wings. In addition, the spray does not roughen the surface of the food to improve adherence of the sauce or help to tenderize the food. Most importantly, the spray pump will not work with thick sauces or sauces that contain chunky ingredients.

SUMMARY OF THE INVENTION WITH OBJECTS

It is one object of the present invention to provide a self contained sauce dispenser which is capable of supplying a controllable flow of sauces from its own containers to the brush tip so that no brush dipping is ever required for sauce replenishment.

It is another object of the present invention to provide a sauce dispenser which works equally well with sauces of different viscosities including those with chunky ingredients.

It is another object of the invention to provide a sauce dispenser which prevents wasteful dripping of the sauce and the usual mess associated with basting brushes.

It is another object of the invention to provide a sauce dispenser which minimizes volatilization of the sauce before it is applied to the food.

It is another object of the invention to provide a sauce dispenser for applying multiple sauces to the same or multiple foods without intermixing the sauces before they are applied to the food.

It is another object of the invention to provide a sauce dispenser which has an enclosable brush applicator cap which acts as a measuring cup and which helps to eliminate the sanitary problem of insects when cooking outdoors.

It is another object of the invention to provide a sauce dispenser in which the ingredients can easily be changed and the dispenser can easily be refilled without creating a mess.

It is still another object of the invention to provide a sauce dispenser with a plurality of resealable and disposable storage containers which can be removed and refrigerated with remaining sauces in them each time after food preparation is completed.

It is another object of the invention to provide a sauce dispenser which works equally well with foods of different textures and consistencies.

It is another object of the present invention to provide a sauce dispenser with a holder which can be mounted on virtually any surface.

It is another object of the invention to provide a sauce dispenser capable of applying a uniform thickness of sauce to food as the food is cooking.

It is another object of the invention to provide a sauce dispenser which roughens the surface of the food as the sauce is applied to improve the adherence and penetration of the sauce into the food.

It is yet another object of the invention to provide a dispenser capable of discharging very thick, chunky sauce.

These and other objects are realized in a cooking sauce dispenser comprising an assembly of one or more tubular, squeezable containers having a circular opening in a plane at an oblique angle to the axis of the container and connected rotatably to a collar having a flow passage for each container. The flow passage for each container is attached to an individual, heat resistant flow tube which terminates in a drip proof flapper valve. The distal end of each flow tube fits into a common flow directing nozzle which contains a bristle brush for applying the sauce to food. By rotating a particular container, the container is caused to extend at an acute angle from the axis of the dispenser. The rotated container is thus easily identified as having the sauce being used for a particular dish and is used as a handle when applying sauce to food. In addition, the acute angle provides a comfortable configuration for applying sauce to food and keeps the users hand out of the hot region directly above the food. When not in use, the dispenser is held upright in a stand configured for the unique shape of the dispenser.

DETAILED DESCRIPTION OF THE EMBODIMENTS

Figure 1:
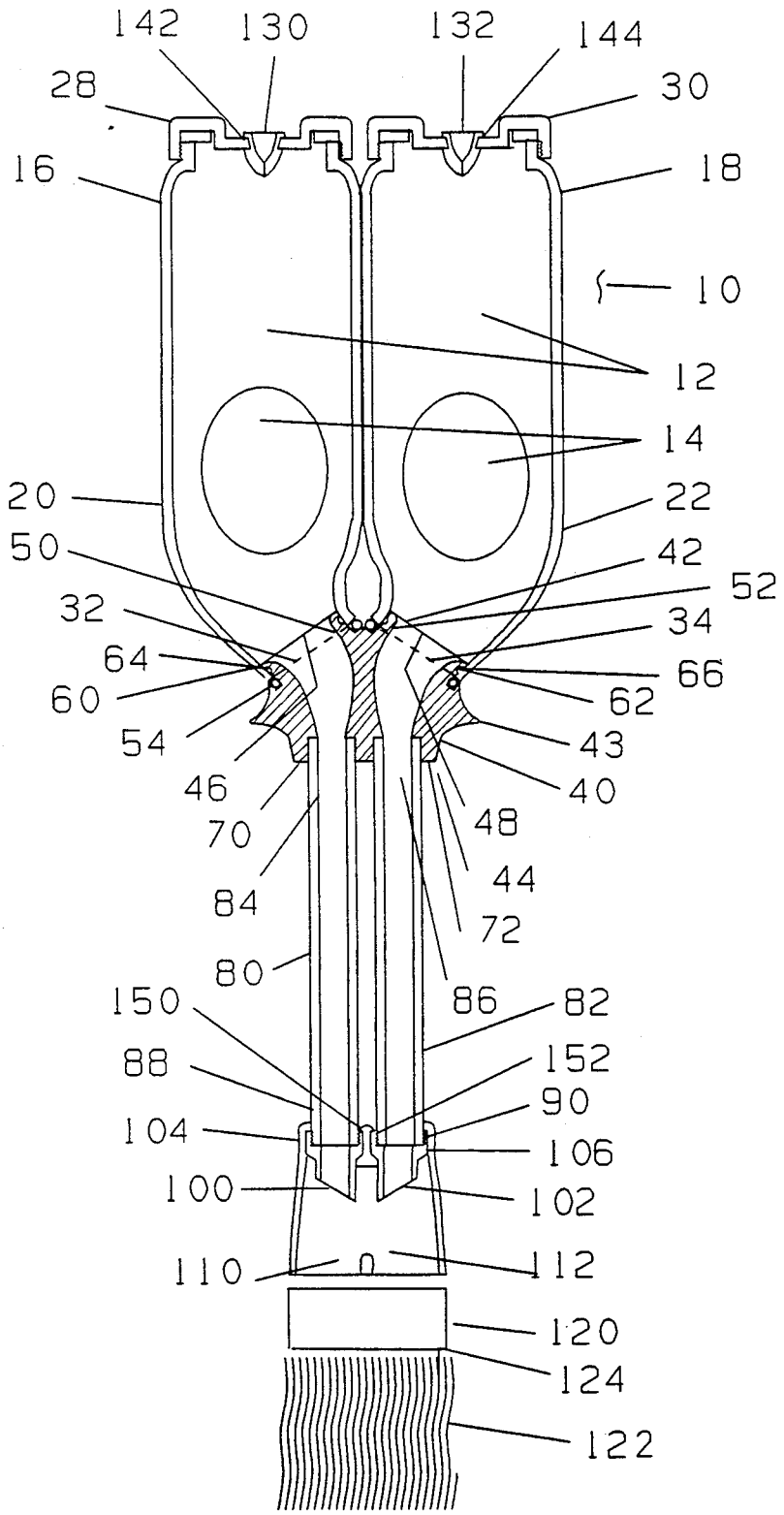
FIG. 1 is a section view of the sauce dispenser in an embodiment designed for application of two different sauces to food.
Figure 1A:
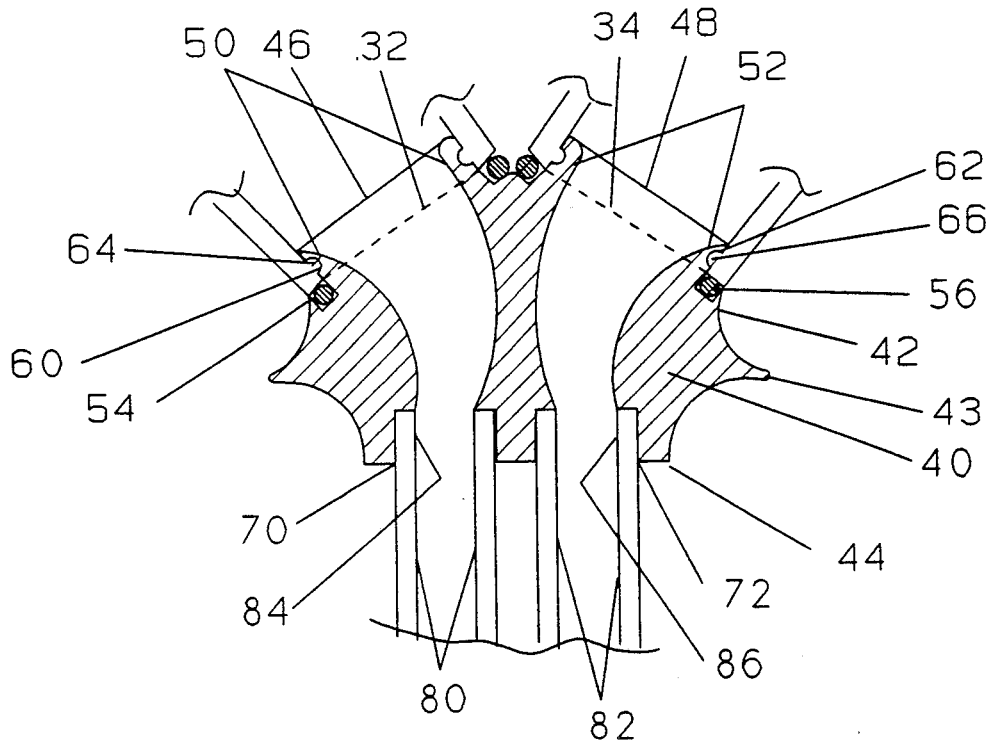
FIG. 1A is an enlarged section view of the connection between the sauce containers and the collar of the present invention.
Figure 1B:
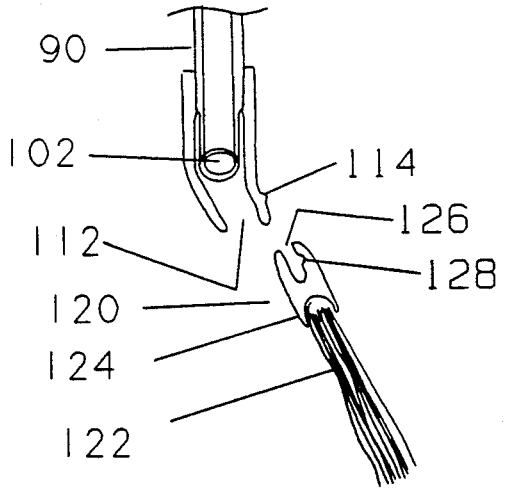
FIG. 1B is an enlarged section view of the brush and flow tube attachment of the present invention.

Referring to FIGS. 1, 1A and 1B one embodiment of the present invention is illustrated in a section view. The dispenser 10 includes two sauce containers 12. The containers 12 are hollow cylinders positioned adjacent to one another with their respective axes parallel. The containers 12 are made of transparent or translucent plastic so that the sauces in them can easily be identified. The walls of containers 12 include diaphragms 14 which are made of plastic material thinner than the walls of containers 12 to allow sufficient flexibility to deflect when squeezed. When diaphragms 14 are squeezed, the sauce contents are forced out of the containers 12. The remainder of the container walls are firm enough for gripping and prevent accidental discharge of sauce when the container is handled. Each container 12 has a fill end 16, 18 and a discharge end 20, 22. The fill ends 16, 18 have male threads for engaging screw caps 28, 30. The discharge ends 20, 22 contain circular discharge apertures 32, 34. Discharge apertures 32, 34 are set in a plane at an oblique angle to the axis of the tubular containers 12 so that the apertures 32, 34 are mirror image in respect to the centerline at the tangential point of contact between the two containers 12.

Referring now to FIG. 1A, discharge ends 20, 22 of containers 12 are connected in a sealed manner to collar 40. Collar 40 is generally conical in shape having a wide end 42 for connection to containers 12 and a narrow end 44 for connection to discharge tubes 80 and 82. Between wide end 42 and narrow end 44 is ridge 43 which extends around the circumference of collar 40. The wide end 42 of collar 40 has two circular apertures 46, 48 which are in a plane at an oblique angle to the axis of containers 12 and at an angle generally supplementary to the angle formed by container discharge apertures 32, 34. The apertures 46, 48 have raised hollow, cylindrical extensions 50, 52. The outside diameters of hollow, cylindrical extensions 50, 52 correspond to the interior diameters of containers 12 walls forming container discharge apertures 32, 34. By placing container discharge apertures 32, 34 over collar 40 raised hollow, cylindrical extensions 50, 52, containers 12 are sealingly and rotatably attached to collar 40. To insure a liquid proof seal, O-rings 54, 56 are placed around raised hollow, cylindrical extensions 50, 52 and abut the ends of container discharge apertures 32, 34. To insure that the containers 12 remain connected to collar 40, the interior of the container discharge apertures 32, 34 contain circular grooves 60, 62 which engage mating circular ridges 64, 66 in collar 40 hollow, cylindrical extensions 50, 52.

With containers 12 connected to collar 40 in the rotatable manner described above, each container 12 can be rotated so that it extends at an acute angle from the centerline of the dispenser 10. In this manner, the acute angle of the container 12 being used, provides a comfortable angle for holding the dispenser while sauce is being applied to food. In addition, the container 12 with the desired sause for the recipe being used can be easily identified. Depending on the design, the angle used for the connection between container 12 and collar 40 can be any angle between 10 degrees and 35 degrees from the vertical. The greater the angle used, the greater distance is achieved between the users hand and the hot region over the food thus improving safety of the dispenser.

Referring back to FIG. 1, the narrow end 44 of conically shaped collar 40 contains two apertures 70, 72. These apertures 70, 72 are sized for receiving ends 84, 86 of discharge tubes 80, 82 in a sealed fashion. The ends 84, 86 of discharge tubes 80, 82 can be press fit, glued or molded into apertures 70, 72 in collar 40 to effect a liquid proof seal. Discharge tubes 80, 82 are formed of stiff, heat resistant material such as the plastic materials used in manufacturing cooking utensils for non stick cook wares. The distal ends of discharge tubes 80, 82 contain threads 88, 90 which engage no-drip tips 100, 102 for dispensing sauces out of containers 12. Clipped to discharge tubes 80, 82 is a discharge conduit 110 which is generally rectangular in cross section and forms a flow passage 112 to direct the sauces onto the food being cooked. Discharge conduit 110 is formed to receive tips 100, 102 in apertures 104, 106. The distal end of discharge conduit 110 is open forming a rectangular outlet 112 for dispensing sauce. As depicted in enlarged FIG. 1B, one edge of rectangular outlet 112 contains a horizontal ridge 114. An applicator brush 120 is formed from soft bristles 122 attached to bristle holder 124. Bristle holder 124 contains a channel 126 sized to fit over the edge of rectangular outlet 112. The channel 126 contains a horizontal groove 128 which engages ridge 114 thereby securing the bristle holder 124 is to the edge of rectangular outlet 112 in an easily detachable manner.

Figure 2:
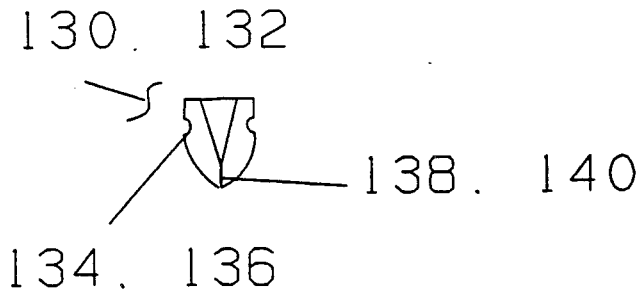
FIG. 2 is an elevation view of the one way air vent valve.

As shown in FIG. 1, screw caps 28, 30 contain one way air valves 130, 132 for admitting air to the containers 12 as sauce is dispensed. Referring now to FIG. 2, valves 130, 132 are formed from soft rubber or silicone material and are a hollow, conical shape. The exterior circumference of the valves contain annular grooves 134, 136. The apex of each of the hollow, conical valves contains a slit 138, 140 through the soft rubber or silicone material. As shown in FIG. 1, the valves 130, 132 are mounted in circular apertures 142, 144 in screw caps 28, 30 with their apexes disposed toward the interior of containers 12. Referring back to FIG. 1, the diameter of apertures 142, 144 are slightly smaller than the base diameter of valves 130, 132. Thus, when valves 130, 132 are inserted in apertures 142, 144, annular grooves 134, 136 engage the circumference of the apertures to form an air-tight seal. Because of the generally conical shape of the valves 130, 132 and the placement of slits 138, 140 at the apex end of the valves, the slits 138, 140 will open when pressure outside the containers 12 is greater than pressure inside the containers thus allowing air to enter the containers. However, if pressure inside the containers is greater than pressure outside the containers, such as when the containers are being squeezed, the shape of valves 130, 132 causes the slits 138, 140 to close thus preventing the flow of air or fluid out of the containers. In this manner, the containers are vented for dispensing sauce but can be pressurized by squeezing the containers.

Figure 3:
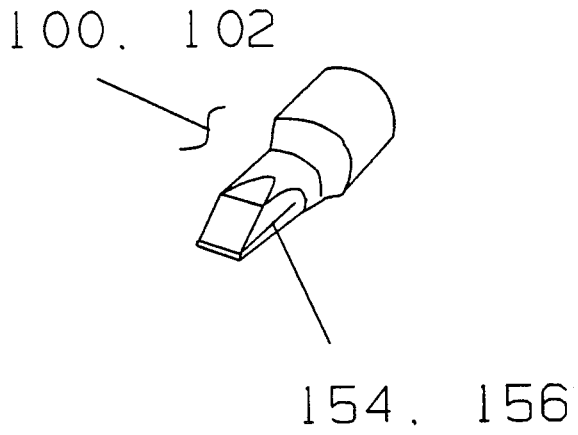
FIG. 3 is an isometric view of the no-drip dispensing tip.

As noted above, the distal ends of discharge tubes 80, 82 are threaded for engaging no-drip tips 100, 102. No-drip tips 100, 102 are cylinders made of semi-stiff, heat resistant plastic material similar to that of the discharge tubes 80, 82. The ends of tips 100, 102 which attach to discharge tubes 80, 82 are hollow and cylindrical and contain internal threads 150, 152 for sealingly attaching to the discharge tubes 80, 82. As indicated in FIG. 3, the distal end of tips 100, 102 contain slits 154, 156 in fluid communication with the interior passages of tips 100, 102. The length of slits 154, 156 is determined partly by the stiffness of the material. The slits will be closed when the diaphragms 14 are not squeezed to prevent dripping of the sauce due to gravity forces but allow free flow of the sauce when the container is pressurized by squeezing. Even though the slits tend to open up after repeated use, capillary attraction prevents even very thin sauces from dripping. The slits are also cut long enough to allow passage of chunky ingredients. As can be readily understood by those skilled in the art, tips 100, 102 can be used for any type of sauces regardless of the viscosity or whether or not they contain chunky ingredients.

Referring now to FIG. 1B, applicator brush 120 contains bristles 122 attached to holder 124. Holder 124 clips onto discharge conduit 110. In this manner, a variety of applicator brushes with different bristle stiffness, length and brush thickness and width can easily be used with the dispenser to achieve optimum results. The bristles should be stiff enough to craze the food leaving a texture for adherence of the sauce but should not mutilate the surface of tender food substances such as fish or vegetables. Thus having an interchangeable applicator brush 120 allows a brush to match perfectly with the food being prepared.

Figure 4A:
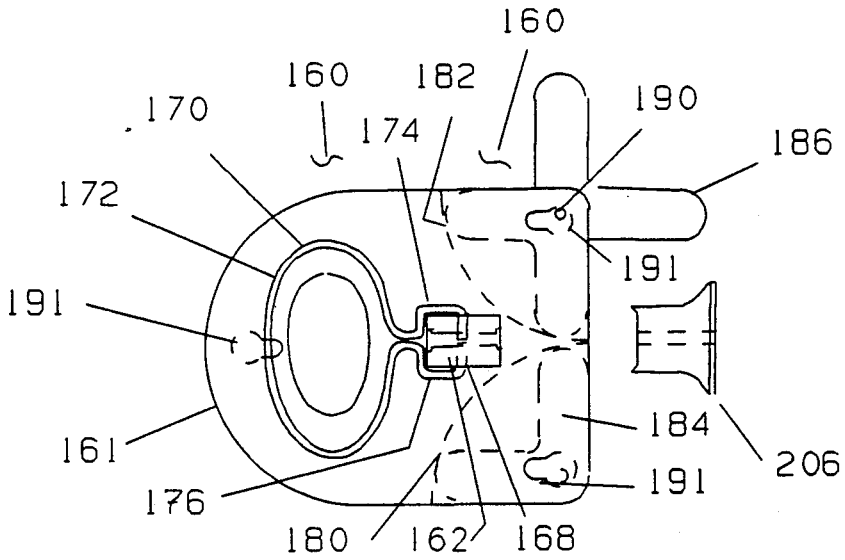
FIG. 4A is a plan view of the dispenser stand.
Figure 4B:
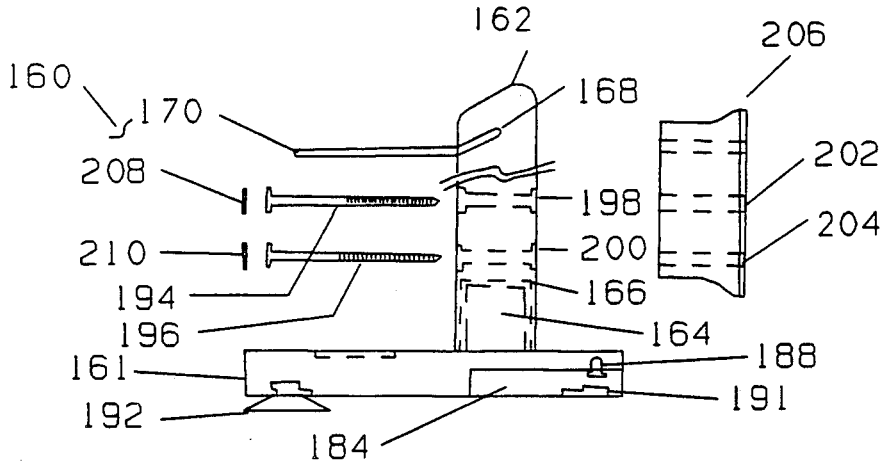
FIG. 4B is an elevation view of the dispenser stand.
Figure 4C:
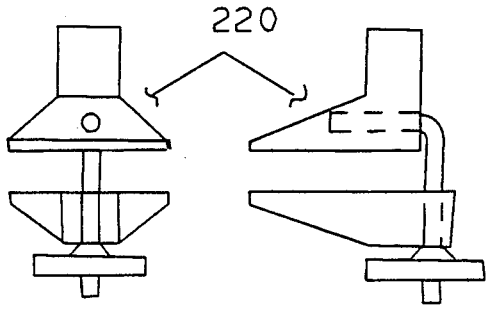
FIG. 4C is a detail of the mounting clamp.

Turning now to FIGS. 4A, 4B and 4C, the dispenser stand is illustrated. The stand 160 consists of a flat, horizontal base plate 161 having a vertical support post 162 extending upward perpendicularly from the base plate 161. Base plate 161 is generally rectangular in plan view with one end of the rectangle trimmed to form a semicircle. Post 162 can be attached to base plate 161 in a variety of ways known to those skilled in the art. The attachment means depicted in FIGS. 4A and 4B consists of a tongue and groove connection where tongue 164 extends vertically from base plate 161 and extends into groove 166 located in post 162. Tongue 164 is press fit to the walls of groove 166 to allow easy dismantling of the stand 160 for cleaning or storage. The top of post 162 contains horizontal aperture 168 for receiving the ends of holding ring 170. Holding ring 170 is formed by bending a rod 172 and is oval in plan view to hold the brush cap 240 shown in FIG. 9 to stand 160. Where the ends of rod 172 come together to form the oval shape of ring 170, the ends are bent in the form of "U" shaped segments 174, 176. The ends of rod 172 abut one another in axial alignment. In this manner, oval ring 170 can be rotatably attached to post 162 by spreading the ends of rod 172 and inserting them in opposite ends of aperture 168. The spring force of oval ring 170 holds the ends of rod 172 within aperture 168.

Figure 8:
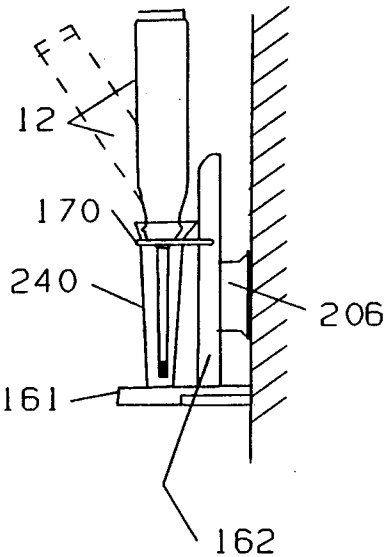
FIG. 8 is an elevation view of the dispenser stand attached to a vertical surface with a spacer block and screws.
Figure 7:
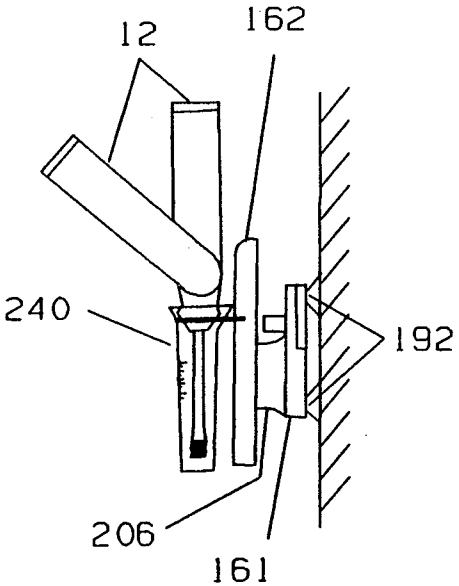
FIG. 7 is an elevation view of the dispenser stand mounted to a flat vertical surface using suction cups.

The underside of base plate 161 has quarter circle recesses 180, 182 located at the corners of the base plate 161. Attached to the underside of base plate 161 at the corners are flat, "L" shaped support legs 184, 186. The attachment of legs 184, 186 to base plate 161 is accomplished with vertical pins or fasteners 188, 190 located at the corners of base plate 161 and extending through the apex sections of legs 184, 186. In this manner, legs 184, 186 can be rotated within recesses 180, 182 to hide under base plate 161 or can be rotated so that the legs extend from base plate 161 to provide additional support for the base plate 161. Also on the underside of base plate 161 are three suction cup slots 191 for removable suction cups 192 which provide further stability when the stand is placed on a smooth, horizontal surface. An alternate method of mounting stand 160 is to attach it to a vertical surface such as a kitchen wall. When the stand 160 is attached to a wall, screws 194, 196 extend through apertures 198, 200 in post 162 and through apertures 202, 204 in spacer block 206 and screw into the surface of the wall or preferably into studs in the wall as indicated in FIG. 8. To maintain a smooth clean appearance of the stand, finish caps 208, 210 can be placed over the heads of screws 194, 196. In an alternate manner, spacer block 206 can be secured to base plate 161 so that post 162 is parallel to plate 161. In this manner, the dispenser can be attached to a vertical surface by suction cups 192 as shown in FIG. 7. A third method of mounting stand 160 is to use a "C" clamp 220 as shown in FIG. 4C. By clamping base plate 161 to a flat, horizontal surface such as the side of a picnic table, the clamp 220 and stand 160 can be readily installed, moved and used, for instance, with an outdoor barbecue stove.

Figure 5:
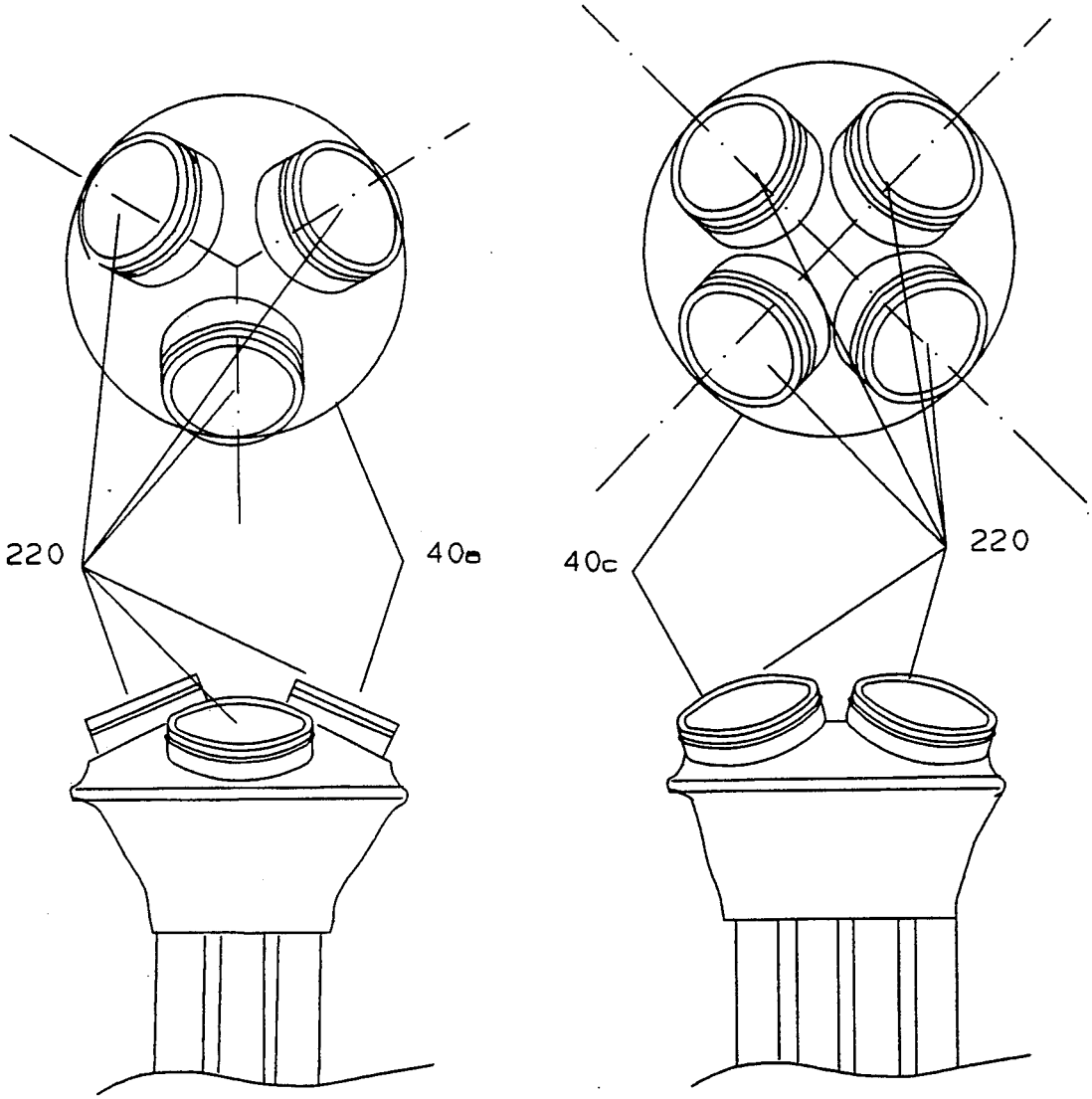
FIG. 5 contains plan and elevation views of alternate embodiments of the dispenser collar for use with three and four sauce containers respectively.

Turning now to FIG. 5, alternate embodiments of collar 40 are depicted in plan and elevation views. Collar **40*a* is similar in design and function to collar 40 except that collar 40*a* contains three apertures 220 for connection to three containers 12. Collar 40*c* is similar but contains four apertures 220 for connection to four containers 12. As is readily understood, the dispenser can be designed for any number of separate sauce containers 12 whereby multiple sauce containers can be stored and used in the dispenser 10. In addition, each container can be separately rotated to an acute angle in relation to the axis of the dispenser 10 thereby making a comfortably angled handle for the user. As will be readily understood, each container will require a separate discharge tube 80**.

Figure 6:
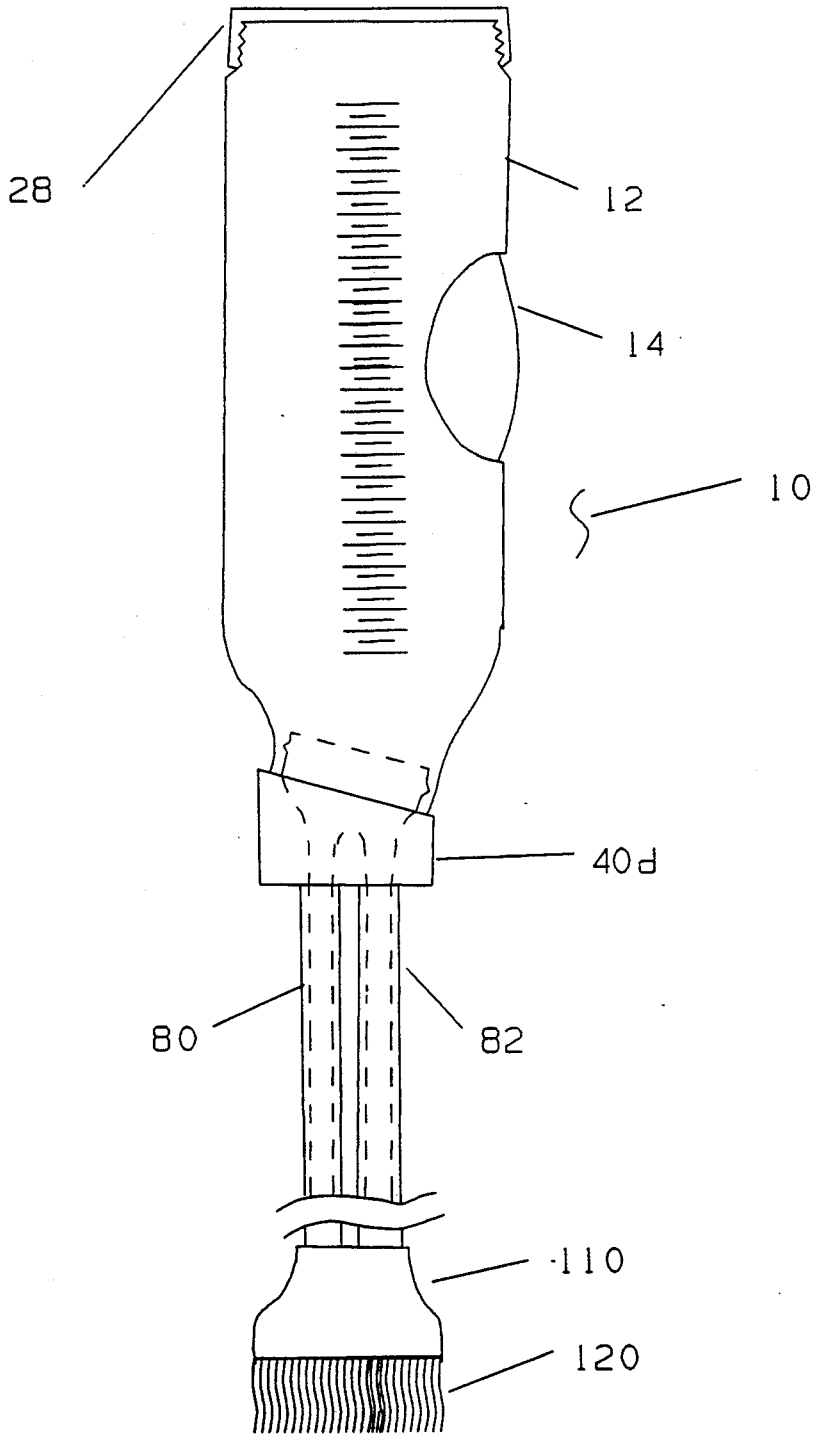
FIG. 6 is an elevation view of the sauce dispenser for application of one sauce to food.

Referring now to FIG. 6, an alternate embodiment of dispenser 10 is shown. In this embodiment, dispenser 10 utilizes one container 12. This embodiment requires using multiple dispensers 10 when applying more than one sauce or refilling container 12 when it is desired to change sauces. However, the single container embodiment has the advantage of lower cost and a light weight, compact design. The commercial version of this single container embodiment is designed to have a much larger container which requires less frequent refilling. Collar **40*d* for the one container embodiment includes the rotatable connection to container 12** to retain the advantages of this connection described above.

Figure 9:
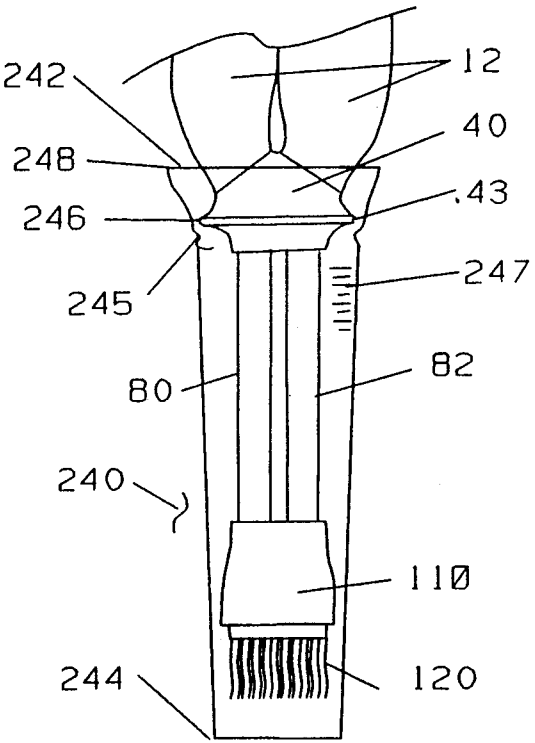
FIG. 9 is an elevation view of the brush cap mounted on the sauce dispenser.

Turning now to FIG. 9, a dispenser brush cap 240 is illustrated. Brush cap 240 is cylindrical in shape having an open end 242 and a closed end 244. Open end 242 contains an internal groove 246 for engaging ridge 43 on collar 40. The brush cap 240 has a horizontal groove 245 for the engagement of holding ring 170. Once the cap 240 is in position, it supports container 12 when the dispenser 10 is placed on stand 160. The ridge 43 may engage groove 246 in a locked, air-tight position for storage or just sit on top of groove 246 in an unlocked, ready to brush position. In either position, insects will be kept out when the brush is used for outdoor cooking. Brush cap 240 is made from transparent material such as clear plastic. It contains graduation volume measurement markings 247 along the side of brush cap 240 and a drip free pouring lip 248. In addition to keeping brush 120 clean when the dispenser is not in use and retaining brush drippings from spilling on base plate 161, brush cap 240 can be used as a measuring cup when a recipe calls for a certain amount of sauce to be added or mixed.

The sauce dispenser and stand thus described and many of its attendant advantages will be understood from the foregoing description and it will be apparent that various changes may be made in the form, construction and arrangement of the parts thereof without departing from the spirit and scope of the invention or sacrificing all of its material advantages, the forms hereinabove described being merely a preferred or exemplary embodiments thereof.

I claim:

1. An elongated cooking sauce dispenser comprising:

a. a plurality of squeezable, tubular sauce containers each having a circular outlet aperture in a plane at an oblique angle to the axis of said container;

b. a hollow collar having a circular inlet aperture and a plurality of outlet apertures;

c. means for rotatably and sealingly connecting one of said container outlet apertures to one of said collar inlet apertures; and d. a plurality of hollow flow tubes each connected to one of said collar outlet apertures with fluid communication passage therebetween for directing said sauce onto food;

whereby rotation of said container about said connecting means causes the axis of said container to form an acute angle with the axis of said elongated dispenser thereby forming a handle which improves the comfort of the user of said sauce dispenser.

2. An elongated cooking sauce dispenser as recited in claim 1 further comprising an applicator brush detachably connected to the distal end of said flow tube for applying said sauce to food.

3. An elongated cooking sauce dispenser as recited in claim 1 further comprising a plurality of no-drip tips each attached to the distal ends of said flow tubes for preventing the flow of sauce when the dispenser is not in use and allowing the flow of sauce when said container is squeezed.

4. An elongated cooking sauce dispenser as recited in claim 1 further comprising a stand for said dispenser, said stand comprising:

a. a flat, horizontal base plate;

b. a vertical post extending upward from said base plate; and c. a ring extending horizontally from the upper portion of said post;

whereby said ring encircles said collar to hold said dispenser in an upright position when said dispenser is not being used.

5. An elongated cooking sauce dispenser as recited in claim 4 wherein said stand further comprises a plurality of "L" shaped legs rotatably mounted in horizontal recesses in the underside of said base plate whereby said legs can be rotated to extend outward from said base plate and improve the lateral stability of said stand.

6. An elongated cooking sauce dispenser as recited in claim 4 wherein said stand further comprises a plurality of suction cups attached to the underside surface of said base plate for removably attaching said base plate to a flat surface.

7. An elongated cooking sauce dispenser as recited in claim 4 wherein said stand further comprises a plurality of adjustable "C" clamps for attaching said base plate to a flat surface.

8. An elongated cooking sauce dispenser as recited in claim 4 wherein said stand further comprises a wall mount bracket for attaching said post to a vertical surface.

9. An elongated cooking sauce dispenser as recited in claim 8 wherein said stand further comprises a plurality of suction cups attached to said base plate and said wall mount bracket attaches said base plate to said post whereby said stand can be removably attached to a flat, vertical surface.

10. An elongated cooking sauce dispenser as recited in claim 1 wherein said container further comprises a detachable filling cap containing a one way vent valve for allowing air to enter said container as sauce is dispensed from said container.

11. An elongated cooking sauce dispenser as recited in claim 2 wherein said dispenser further comprises a hollow brush cover having an open end and a closed end, said open end detachably connecting to said collar thereby enclosing said applicator brush and preventing contamination of said brush when said dispenser is not in use.

12. An elongated cooking sauce dispenser as recited in claim 3 wherein said no-drip tip further comprises:

a. a hollow, cylinder having an open end and a closed end;

b. internal threads within said open end of said tip for threadingly engaging said distal end of said flow tube; and c. a slit cut in said closed end of said tip, said slit having a narrow width and being in fluid communication with the interior of said tip.

13. An elongated cooking sauce dispenser comprising:

a. a plurality of squeezable, tubular sauce containers each having a circular outlet aperture in a plane at an oblique angle to the axis of said container;

b. a hollow collar having a plurality of circular inlet apertures and a plurality of outlet apertures;

c. means for rotatably and sealingly connecting one of said container outlet apertures to one of said collar inlet apertures;

d. a plurality of hollow flow tubes each connected to one of said collar outlet apertures with fluid communication passage therebetween;

e. a plurality of no-drip tips each attached to the distal end of said flow tubes for preventing the flow of sauce when the dispenser is not in use and allowing the flow of sauce when said container is squeezed;

f. an applicator brush detachably connected to the distal end of said flow tube for applying said sauce to food; and g. a stand comprising a flat, horizontal base plate, a vertical post extending upward from said base plate, and a ring extending horizontally from the upper portion of said post, encircling said collar and holding said dispenser in an upright position.

whereby rotation of said container about said connecting means causes the axis of said container to form an acute angle with the axis of said elongated dispenser thereby forming a handle which improves the comfort of the user while sauce is being applied to food.

* * * * *